US005626399A

United States Patent [19]

Bunker

[11] Patent Number: 5,626,399

[45] Date of Patent: May 6, 1997

[54] APPARATUS FOR CUTTING AND EXCAVATING SOLIDS

[75] Inventor: Christopher A. Bunker, Brisbane, Australia

[73] Assignee: The University of Queensland, Queensland, Australia

[21] Appl. No.: 379,677

[22] PCT Filed: Aug. 26, 1993

[86] PCT No.: PCT/AU93/00439

§ 371 Date: Feb. 8, 1995

§ 102(e) Date: Feb. 8, 1995

[87] PCT Pub. No.: WO94/04791

PCT Pub. Date: Mar. 3, 1994

[30] Foreign Application Priority Data

Aug. 26, 1992 [AU] Australia ..... PL4302

[51] Int. Cl.[6] ..... E21C 25/18

[52] U.S. Cl. ..... 299/41.1; 299/53; 299/78

[58] Field of Search ..... 299/55, 41, 39, 299/89, 59, 39.3, 42, 44, 45, 53, 78

[56] References Cited

U.S. PATENT DOCUMENTS

| | | | |
|---|---|---|---|
| 2,572,403 | 10/1951 | Stevenson | 299/55 |
| 2,753,167 | 7/1956 | Brown | 299/59 |

FOREIGN PATENT DOCUMENTS

| | | | |
|---|---|---|---|
| 26373/77 | 1/1979 | Australia . | |
| 46897/89 | 6/1990 | Australia . | |
| 258209 | 5/1970 | U.S.S.R. | 299/89 |
| 514950 | 9/1976 | U.S.S.R. | 299/89 |
| 653389 | 3/1979 | U.S.S.R. | 299/89 |
| WO93/05242 | 3/1993 | WIPO . | |

OTHER PUBLICATIONS

"Schneidend–brechende Gewinnung mit der Schneidscheibe", Von Friderick Eichbaum doctoral thesis, 1980 (and English translations).

*Primary Examiner*—David J. Bagnell

*Attorney, Agent, or Firm*—Nixon & Vanderhye P.C.

[57] ABSTRACT

An apparatus for cutting and breaking rock includes a cutting disc (13) having an attached wedge (11). Cutting disc (13) can be rotated by shaft (16) to cut a groove into rock. After a pre-determined distance, wedge (11) is forced into the cut groove to cause the rock above the groove to be broken away. Shaft (16) is powered by a drive motor, and can include a kick back mechanism to prevent wedge (11) from being trapped in the cut groove. The entire apparatus can be mounted to the three point linkage of a tractor.

18 Claims, 4 Drawing Sheets

Fig. 5
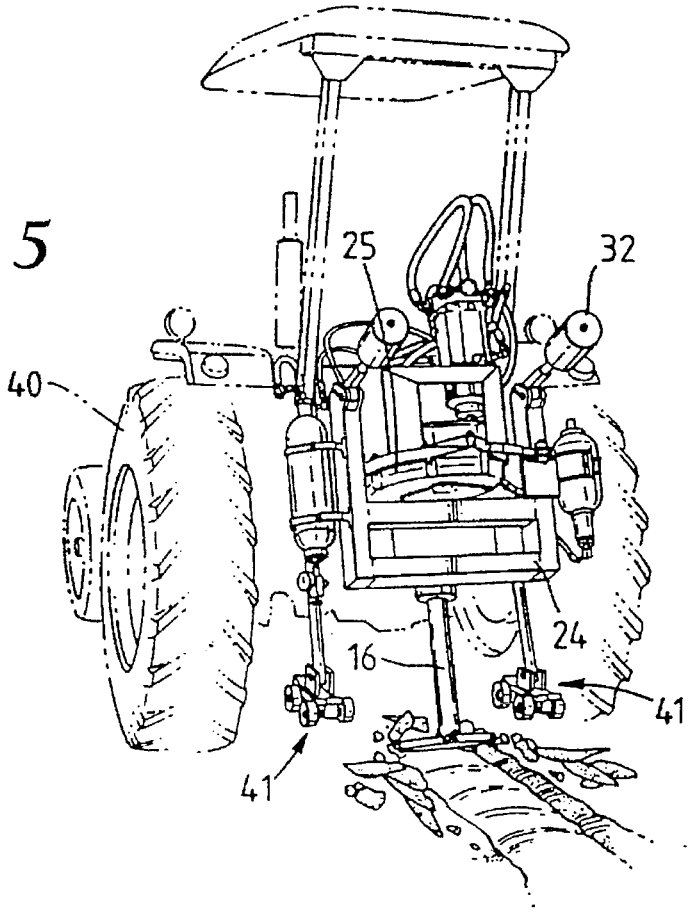
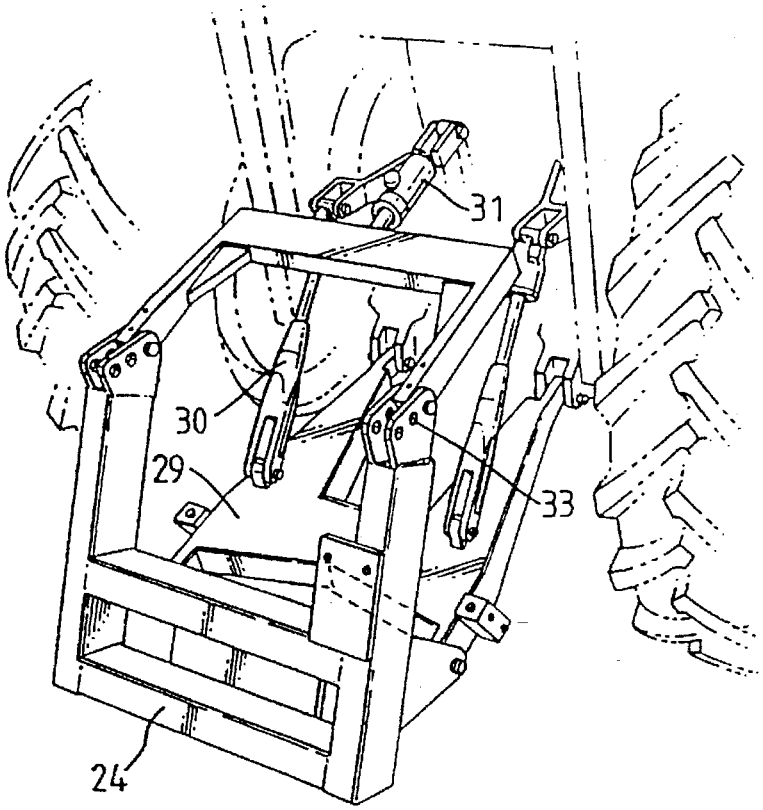
Fig. 6

APPARATUS FOR CUTTING AND EXCAVATING SOLIDS

TECHNICAL FIELD

THIS INVENTION relates to an apparatus for cutting and excavating solids and particularly to an apparatus which can cut and break rock, coal, stone and the like.

BACKGROUND ART

Excavation of solids such as rock, coal, stone, ores, and the like is required in a variety of circumstances. These include in the mining industry for recovering ore, quarries, recovery of coal, sinking of bore holes, excavation of tunnels and the like for sewerage, conduit lines, vehicles, and cutting of trenches, channels and the like.

It is known to excavate solids using basting techniques. However, blasting techniques are less suitable for excavation of tunnels, trenches or channels. Blasting also requires strict safety precautions.

Another technique to excavate solids is by using cutting or grinding apparatus. Such apparatus are provided with one or more cutting discs which are provided with peripheral teeth (or picks). The discs are forced against the solid to be cut at extremely high forces and cause the solid to be cut away in small pieces.

A disadvantage with this type of apparatus is that the cutting process is extremely energy intensive and extremely energy inefficient. The technique releases large amounts of heat and requires large equipment to provide the necessary power to rotate the cutting discs and to force the cutting discs against a rock face.

Examples of such apparatus are found in the Wohlmeyer U.S. Pat. Nos. 2,758,825, 3,297,101 and 3,379,024.

One disadvantage with excavating rock in a purely cutting process, is the enormous wear and tear placed on the cutting disc and its cutting teeth. Thus, a high degree of maintenance is required on the cutter discs.

The apparatus is also of a large size to accommodate the equipment necessary to power and hold the cutter discs. Thus, the apparatus is expensive to use and maintain and is unsuitable for relatively small-scale excavations. These known apparatus are currently used in tunnelling.

In order to improve the effectiveness of solid removal, it has been known to use a principle called "cut and break". In this process, an apparatus initially cuts a groove in the solid with a cutting disc and then inserts a wedge into the cut groove in a separate action. The wedge causes the rock or other solid to break away from the groove. Thus, excavation of the solid is due to a cutting action and a separate breaking action.

A known apparatus using this cut and break technique is known as a "McKinlay Entry Driver" which appears to have been used in the U.S.A. in about 1918.

The apparatus was limited in its use to cutting holes for tunnels and the like and was unable to cut trenches.

This apparatus consisted of a horizontal shaft to which an arm was mounted at right angles. The arm extended to each side of the shaft. To the arm were fixed a number of cutting plates which extended at right angles to the arm. Upon rotation of the shaft, the arm was rotated and therefore the cutting plates were rotated in a circular motion. When the machine was forced against a coal face, it caused annular grooves to be cut into the coal face. On a secondary arm was fixed a wedge which was exactly positioned such that upon rotation of the shaft, the wedge was caused to enter into one of the grooves formed by the cutting plate therefore causing the coal to burst apart.

This type of apparatus still suffered from a number of disadvantages including its size, complexity and expense.

Another disadvantage was the requirement to correctly position the wedge on the secondary arm to ensure that it was caused to enter into a cut groove and did not scrape against the coal face. If a particular cutting plate was damaged and therefore resulted in a different type of groove being cut, this could result in the wedge not properly entering into the groove. Furthermore, if a cutting plate was replaced, it was often necessary to ensure that the wedge was repositioned correctly.

Another disadvantage with the wedge (also called a "wedging wheel" or "bursting wheel") was the possibility of it becoming trapped in the groove. Should this occur, and if the rock was extremely hard or did not burst, the result was that either the wedge would be destroyed or deformed or that the motor driving the shaft would burn out.

Should the wedge be deformed or destroyed, it was necessary to shut down the apparatus for replacement and re-positioning of the wedge.

Due to the difficulties with the wedges, the more modern cutting machines dispensed with them altogether.

DISCLOSURE OF THE INVENTION

We have now developed an apparatus which can utilise the cut and break principle of excavation and where the difficulties in using the wedge as described above may have been substantially overcome.

We achieve this by positioning the wedge on the cutting disc. Thus, there is no requirement for secondary arms and there is no requirement to ensure that the wedge is accurately positioned on a secondary arm.

As an option, we can provide an apparatus with a "kick-back" mechanism to minimise the possibility of the wedge being trapped in the cut groove.

Therefore, in one form the invention resides in an apparatus for cutting and breaking a solid, the apparatus having a cutting disc with a peripheral edge, a top wall and a bottom wall, and a wedge located on at least one of said walls and extending therefrom and spaced inwardly relative to the peripheral edge of the cutting disc.

In this manner, we find that the cutting disc can initially cut the groove and when the groove is at a predetermined depth (corresponding to the spacing between the periphery of the cutting disc and the wedge), the wedge will enter into the cut groove and will cause the solid to be broken.

The wedge may be provided on either the top wall or the bottom wall and it is preferred that a wedge is provided on both the top wall and the bottom wall of the cutting disc.

If desired, the wedge may be rotatably mounted relative to the cutting disc. In this manner, the wedge may be rotatably inserted into a cut groove which may minimise wear.

Suitably, a pair of wedges are provided, one on the top wall and one on the bottom wall of the cutting disc and whereby the wedges can be connected together.

The wedge may be adjustably mounted to the cutter disc to allow it to extend from the cutter disc at a plurality of distances. This may be of advantage should the hardness of the vary according to cutting depth. It may also allow the cutting disc to enter deeply into the cut groove with subsequent expansion of the wedge to cause the rock to break.

The wedge may be spaced inwardly from the peripheral edge of the cutting disc by varying distances depending on the type of rock to be cut and the cutting action, power capability of the apparatus and the like. For instance, with soft friable solid, the wedge can be spaced more towards the peripheral edge and can have a higher raised profile. For hard friable rock, the wedge can be spaced closer to the centre of the cutting disc to improve its leverage. For hard non-friable rock, the wedge height may be reduced.

The profile of the wedge surface may vary and may depend on the type of solid to be cut and the type of cutting action.

If the wedge is rotatably mounted to the cutting disc, it is preferred that the wedge profile is symmetrical about its rotation axis. One type of profile may include a cone shape or a "pyramid" shape (also called a "mushroom" shape). The angle of the profile (i.e., the distance that the wedge can be raised above the cutting disc) may also vary. The angle may be between 1° to 10°, if desired. If a pair of wedges are provided, each wedge may have an identical or a different profile relative to the other. In one form, the wedges may have identical profiles while in another form, one wedge may be substantially planar while the other wedge may have pyramid type shape.

It is preferred that the apparatus is provided with a pair of wedges which are connected to an attachment member, the attachment member being mountable in an aperture in the cutting disc. The attachment member may threadingly engage with the opening in the cutting disc.

The cutting disc may be substantially circular when viewed in plan. The periphery of the disc may be slightly thickened relative to the remaining body of the disc. One or more cutting teeth may be provided and these may be mounted adjacent the periphery of the cutting disc. Preferably, a plurality of cutting teeth are provided. The teeth may be equally spaced about the periphery of the disc but it is preferred that cutting teeth are not present in the immediate vicinity of the wedge. The cutting teeth may be at various angles and it is preferred that some of the cutting teeth extend upwardly from the cutting disc, some of the cutting teeth are in line with the cutting disc and some of the cutting teeth are spaced downwardly from the cutting disc. This can ensure that the cut groove is sufficiently large to accommodate the cutting disc without the cutting disc itself becoming wedged in the groove.

The cutting disc may be attachable to adjacent one end of a rotatable shaft member. The rotatable shaft member may be driven by a drive means. The drive means may be hydraulic, pneumatic, electric or internal combustion.

Suitably, the drive means is coupled to a reduction gearbox to provide the rotatable shaft member with a lower rotating speed but high torque.

The shaft may be supported by support framework. The support framework may also support the drive means and gearbox.

The rotatable shaft member may be biasable towards and away from the solid to be cut, by a biasing means. Preferably, the biasing means is sufficient to provide sufficient force to the cutting disc to allow it to efficiently cut into the solid, however, not strong enough to prevent "kick-back" of the rotatable shaft member should the wedge become Jammed or stuck within the cut groove.

The biasing means may be hydraulic, pneumatic or mechanical. Suitably, the supporting framework is pivotly mounted and the biasing means can function to bias the supporting framework and therefore the rotatable shaft member towards and away from the solid to be cut.

BRIEF DESCRIPTION OF THE DRAWINGS

An embodiment of the invention will now be described with reference to the drawings in which

FIG. 5 is a view of the apparatus of FIG. 4 attached to the three-point linkage of a tractor;

FIG. 6 illustrates in greater detail the linkage of FIG. 5;

DESCRIPTION OF PREFERRED EMBODIMENTS OF THE INVENTION

Figure 1:
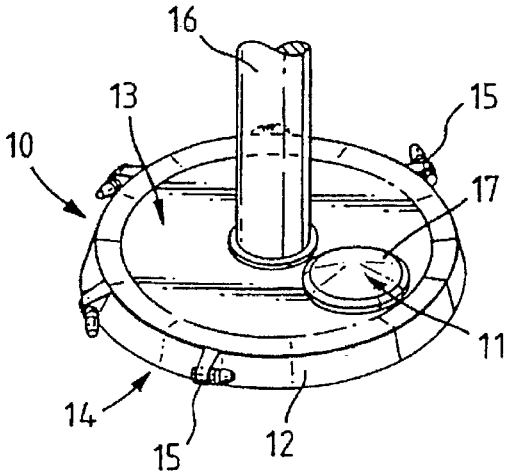
FIG. 1 illustrates a cutting disc according to an embodiment of the invention, including a wedge.

Referring to FIG. 1 there is illustrated a cutting disc 10 to which is fitted a wedge 11. Cutting disc 10 is more or less of conventional design and is circular when viewed in plan. Cutting disc 10 is provided with a top wall 13 and a bottom wall 14. Top wall 13 is slightly smaller in diameter relative to bottom wall 14, thereby resulting in peripheral edge 12 being outwardly tapered. Peripheral edge 12 is also thickened relative to the main portion of top wall 13 as is illustrated in FIG. 1.

Attached to peripheral edge 12 are a plurality of cutting teeth or picks 15. Picks 15 are conventional insert picks, in which a tungsten carbide tool tip is inserted into an axial hole in the steel main body of the pick and are used for gauge cutting. Capped picks in which the tungsten carbide tool tip takes the form of a blunt pointed cap covering the end of a steel shank of the pick are used for the rest of the cutting. The picks are conventionally laced apart from having two pairs of cutters for gauge cutting. The reason for using two pairs of gauge cutters is to ensure that the groove which is cut has sharp stress-concentrating corners, making for easy breaking. Picks 15 are arranged such that some of the picks extend above top wall 13, some of the picks extend below bottom wall 14 and some of the picks are in line. It is also noted that picks 15 are absent at the periphery immediately around wedge 11. Cutting disc 10 is mounted to a rotatable shaft 16 which itself can be rotated by a drive means which shall be described in greater detail below and with reference to FIG. 4.

Figure 2:
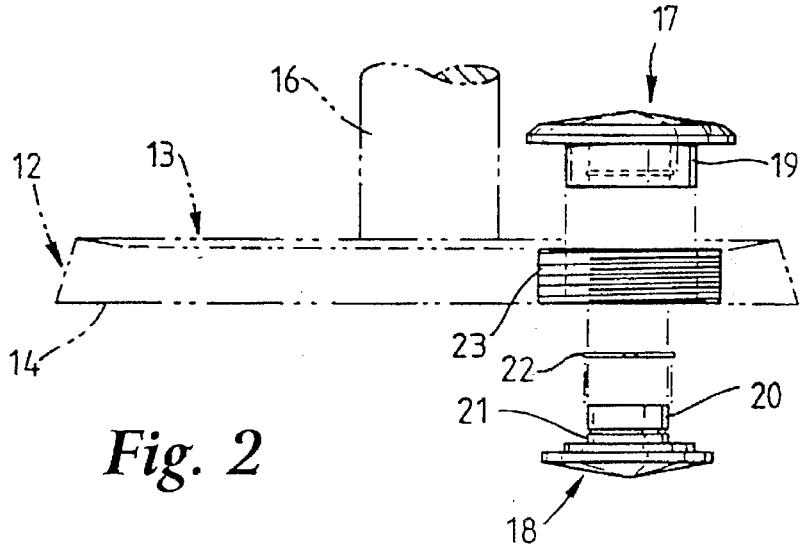
FIG. 2 illustrates the positioning of a pair of wedges on the cutting disc of FIG. 1.
Figure 3:
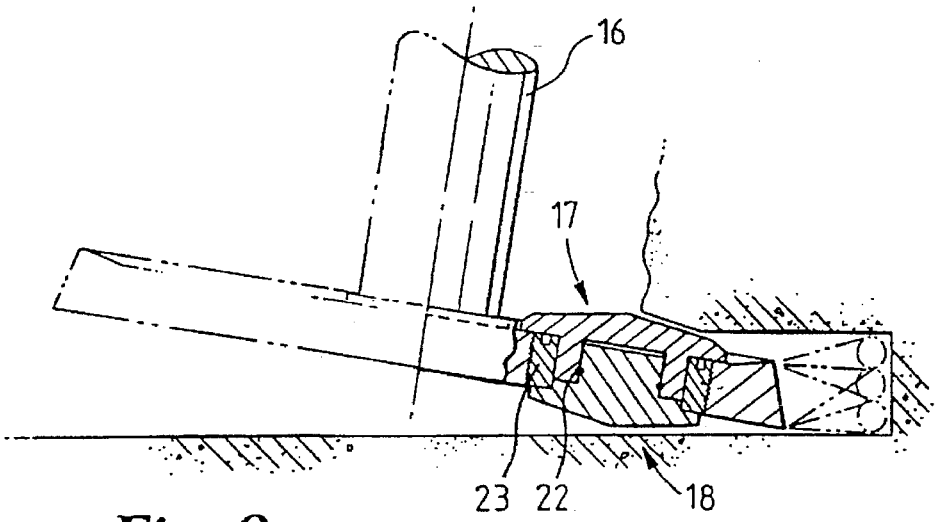
FIG. 3 is a side part section view of the cutting disc of FIG. 1 in use.

Wedge assembly 11 is formed from a pair of wedges being upper wedge 17 and lower wedge 18, more clearly shown with reference to FIGS. 2 and 3. Each of wedges 17 and 18 in this embodiment have a "pyramid" or "mushroom" profile. Each of wedges 17 and 18 include a depending collar portion 19, 20 with collar portion 20 being of reduced diameter relative to collar portion 19 to enable one to slide within the other. Collar portion 20 includes an annular groove 21 in which can be fitted a clip 22 to fit wedges 17 and 18 together. In this arrangement, wedges 17 and 18 are free to rotate relative to each other. Wedges 17 and 18 are fitted to an attachment portion 23 which is in the form of a annulus having an external thread. The annulus fits within a corresponding threaded opening within cutting disc 10 and this results in attachment portion 23 being securely threadingly engaged with cutting disc 13. Collar portions 19 and 20 can fit within attachment portion 23. There is about a 1 mm clearance between the various parts to allow dirt which may enter the arrangement to leave but without allowing larger particles to get in. The parts are easily assembled but requires a sledgehammer and wedges to take them apart.

FIG. 3 shows a part section view of the cutting disc 13 and wedge assembly 11 of FIG. 1 and shows how the various parts can be fitted together.

Figure 4:
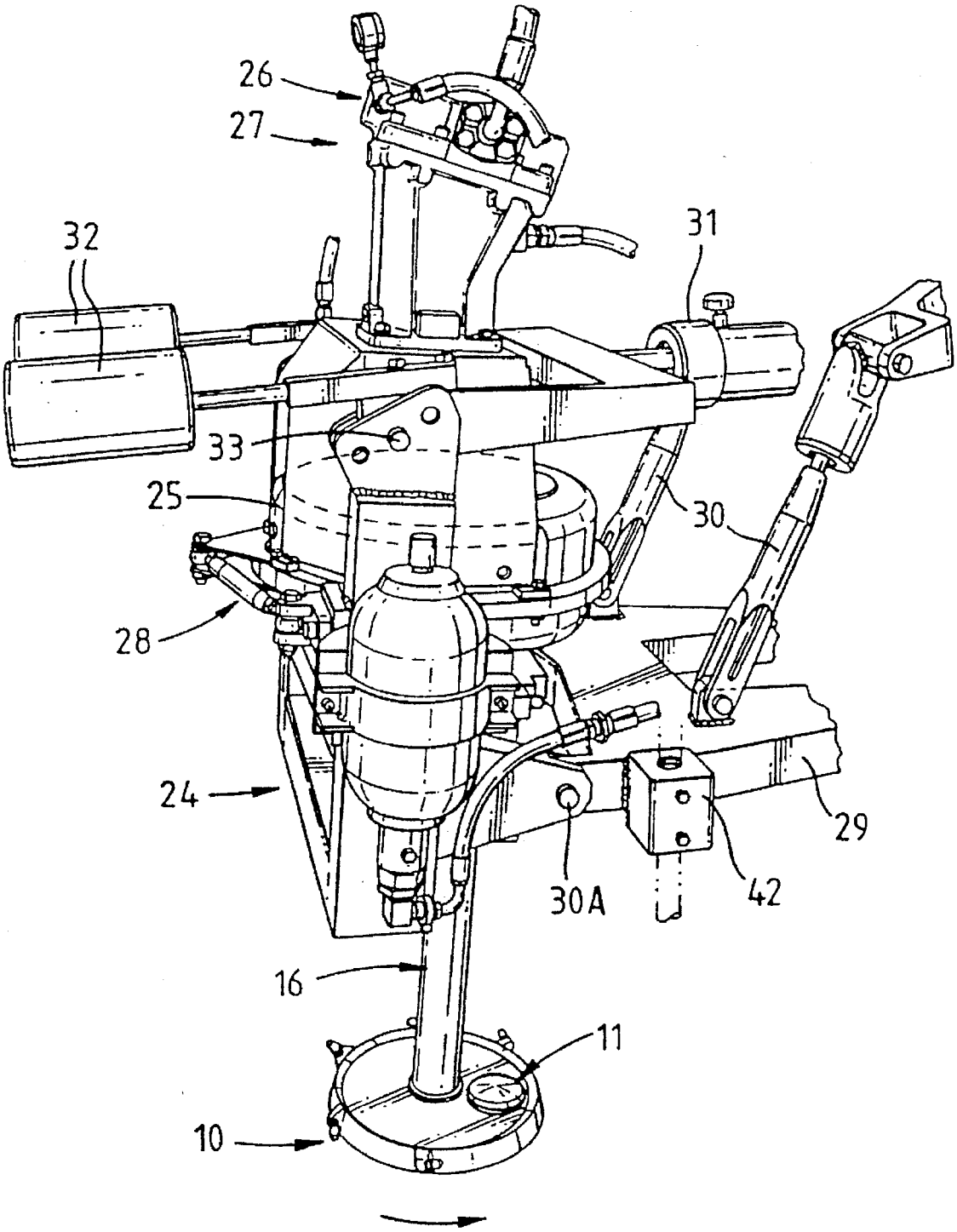
FIG. 4 is a view of an apparatus to rotate the cutting disc as illustrated in FIG. 1.

Cutting disc 10 is rotated and mounted by an assembly, an embodiment of which is illustrated in FIG. 4.

The assembly comprises cutting disc 10 fitted to rotating shaft 16. Rotating shaft 16 is supported through a bearing in supporting framework 24 (bearing not shown).

Upper end of shaft 16 is connected to a reduction gearbox 25. The assembly can be fitted to a three-point linkage of a tractor and can be powered from the output drive shaft or power take-off (not shown) of the tractor. The output drive shaft of the tractor typically rotates at a nominal 1,000 rpm and can be rated at approximately 20 kW. The output drive shaft of the tractor drives a fixed capacity hydraulic pump 26 having a displacement of about 50 ml per revolution. The hydraulic oil at a maximum nominal 3,000 psi pressure drives a variable capacity motor 27 having a maximum displacement of 105 ml, minimum of about a quarter of that figure.

The variable capacity provides the possibility of varying the speed of the final drive.

Motor 27 drives gearbox 25 which is a 25:1 reduction gearbox of substantial dimensions to bring the final speed down to a nominal 20 rpm. The system is designed for average torque of 5,000 Nm. The gearbox is of a variety whereby the shaft passes through the gearbox, the only connection between the gearbox and the frame of the machine, apart from the shaft being by a torque arm 28. The gearbox is manufactured by Bonfiglioni.

Supporting framework 24 is pivotly mounted to a second support 29, with second support 29 being pivotly mounted to link arms 30 which form part of the tractor linkage assembly. The pivot mounting point is illustrated as 30A.

Framework 24 is fitted at an upper portion thereof to a biasing means in the form of an hydraulic ram 31 which is itself powered by the tractor. Hydraulic ram 31 also functions to allow cutting disc 10 to "kick-back" should wedge assembly 11 become trapped within the cut groove and as shall be described in greater detail below.

Counter-weights 32 are provided to balance the assembly.

The angle by which shaft 16 (and therefore cutting disc 10) extends below the drive assembly can be varied through attachment points 33. It can be seen that three attachment points are provided and by inserting a fastener into a particular attachment point, frame assembly 24 can be moved to different angle configurations which will in turn will vary the angle of shaft 16 and therefore cutting disc 10. The angle can vary to the vertical of 5° to 25°.

FIG. 5 illustrates the apparatus attached to a tractor and like numbers have been used to illustrate like components. The apparatus can be fitted to the three-point linkage arms of the tractor, together with a parallelogram linkage for the main frame, detail of which is shown with respect to FIG. 6.

As the tractor illustrated in FIG. 1 (or other like vehicle) is provided with pneumatic wheels 40, a pair of stabilisers 41 are provided to prevent rocking of the apparatus during use. The stabilisers are in the form of steel rollers which can be fitted to second support 29 through box 42 (see FIG. 4). The arrangement also allows the rollers to be adjustable in length. Hydraulic rams may be used to push rollers 41 onto the ground to transfer some of the weight of the tractor from the tractor tyres to the rollers 40.

Hydraulic ram 31 (see FIG. 4) is fitted to allow the top link of the parallelogram linkage arrangement to shorten slightly when it is under large compressive load. This allows cutting disc 10 to move backwards slightly. Hydraulic ram 31 is filled with oil under pressure of gas in a reservoir. When the load on ram 31 exceeds the force exerted on the ram by the pressurised oil, the ram is forced back allowing the upper link to shorten. The process is one which increases the pressure of the gas in a reservoir, and so force required to shorten the link becomes progressively larger. The rate of increase is governed by the gas volume in the reservoir, the pressure and volume in turn being determined by the initial pressure of the gas in the reservoir and the volume of oil subsequently admitted.

In use, to cut into a flat surface, cutting disc 10 is lowered into a contact position (the angle being determined through pivot 33) and pressure is then applied to cutting disc 10 to excavate a shallow cut. The tractor is advanced very slightly and the cut is deepened and widened slightly. By creeping very slowly forward as disc 10 cuts, it is possible to bury the disc until rollers 41 bear on the ground surface and the cutting wheel is ready to operate at the desired depth.

The present machine is driven forward by a winch, which runs slowly because of a small choke orifice being placed in the oil supply line to it. The effect of the choke is to ensure that the winch has almost zero torque when it is running at its maximum speed, the torque becoming greater as the winch slows, reaching a maximum just as it is about to stall. The forward speed of the tractor is so slow that in practice the winch is running at a speed not much above a stall. In this condition, the advance of the tractor depends upon the progress of the cutting wheel, and this cuts faster the greater the load upon it, up until the point is reached when the cutting wheel drive stalls because the drive motor can no longer provide the necessary force to rotate it. Moderately sensitive control of the near-stall force from the winch is obtained through the use of a pressure regulating valve in the winch hydraulic line, which sets a maximum pressure which may be applied to the winch. In practice the driver watches the pressure gauge in the oil supply line to the cutting wheel motor, and adjusts the pressure of the oil in the winch drive so as to keep the cutting wheel drive pressure close to the maximum of which the drive system is capable of supplying. Should the cutting wheel stall, the pressure to the winch is reduced, and this is usually sufficient to allow the cutting wheel to restart. This is obviously unsatisfactory for any but an experimental machine, and proposed future machines will incorporate an automatic system to control the advance of the machine whilst ensuring the cutting wheel picks are always operating at a load close to the maximum.

Figure 7:
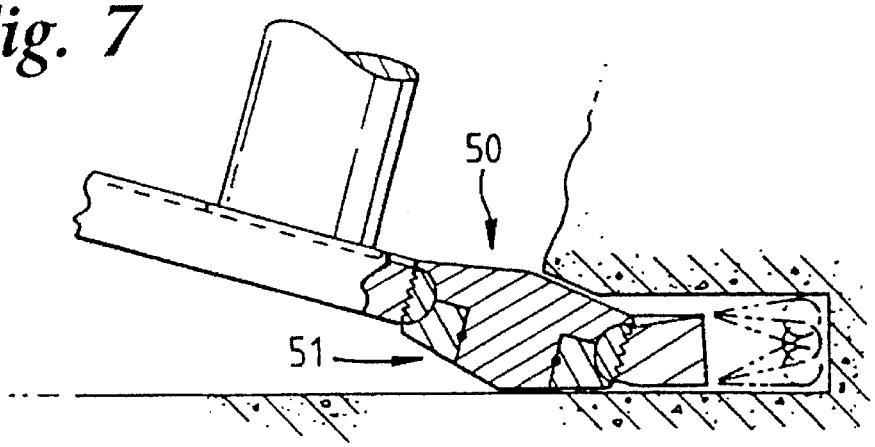
FIG. 7 illustrates the cutting disc being used.
Figure 8:
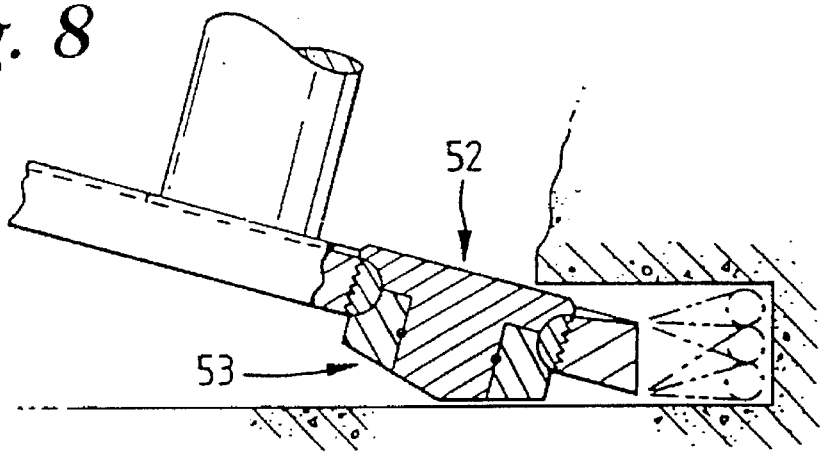
FIG. 8 illustrates a cutting disc having an alternative wedge arrangement.
Figure 9:
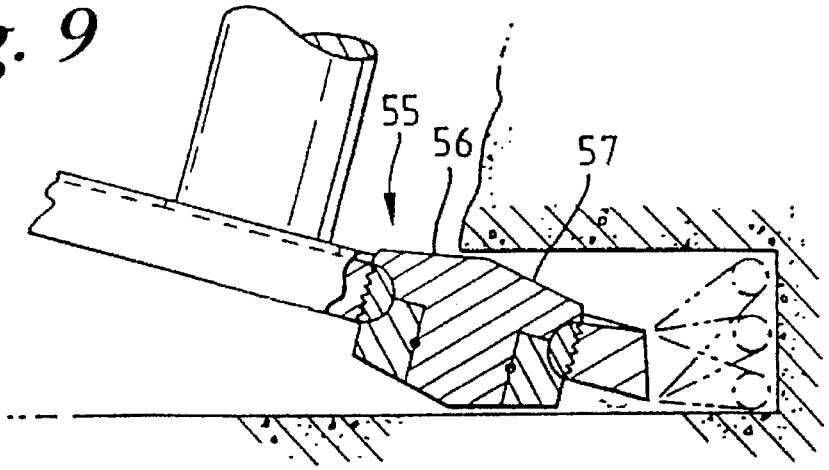
FIG. 9 illustrates a cutting disc having yet a further alternative wedge arrangement.

Referring to FIGS. 7 to 9, there are shown various wedge assemblies. In FIG. 7, top wedge 50 and bottom wedge 51 have the same profile. The angle of bottom wedge 51 in the embodiment is chosen to be the same as the angle of inclination of cutting disc 10 so that bottom wedge 51 lies flat upon the excavated bottom of the cut groove. The shape of the top wedge 50 can depend upon the type of rock being excavated and in particular upon the rock strength and its friability. Friable rock (i.e., sandstone) wears away quickly and so the top of wedge 50 needs to be higher to compensate for this than is the case with a wear-resistant rock.

FIG. 8 shows an alternative wedge arrangement wherein top wedge 52 is substantially planar and bottom wedge 53 is of a pyramid shape.

Referring to FIG. 9, in this embodiment the wedge assembly is particularly suitable for hard, strong and wear-resistant rock. The wedge assembly in this arrangement comprises a top wedge 55 where the trailing surface 56 is caused to wedge within the cut to form the bursting action rather than leading surface 57. In this arrangement, much more leverage is applied than is the case with reference to FIGS. 7 and 8.

Various changes and modifications may be made to the embodiment described. For instance, cutting disc 10 may contain a number of wedges 11 and may contain a number of sets of wedges. We believe that large cutting discs can be fitted with two or more of the wedge assemblies. The wedges may rotate relative to cutting disc 10 or may be fixed thereto, or if they do rotate, may rotate independently of other wedges.

The wedges may be expandable or retractable such that it extends above the general profile of the cutting disc to break the under-cut material. It is envisaged that this could be achieved by including a hydraulic ram or by admitting high-pressure water through cutting disc 10 to operate the wedges. If high-pressure water is used, it may also be passed through nozzles to have the dual effect of flushing away debris and exerting an extra large force on the under-cut material.

Thus, rotating shaft 16 may be hollow and a space may be provided with a phasing valve to be used with a high-pressure water supply. This may increase the efficiency of the picks.

It may be possible to enclose shaft 16 within a strong sleeve which may be fitted with a wedged shape, pointed leading edge so that should the under-cut rock reach the shaft without breaking, there may be a splitting action to break the under-cut rock. This may be advantageous when cutting rock with a tendency to split into large flat slabs as do some sedimentary rocks, so that the bursting wheel has broken free a large slab which just lies in position, preventing forward motion of the machine. Alternatively, shaft 16 may be fitted with picks or other forms of cutting teeth so it may cut its own path.

A number of cutting discs may be provided. If only one cutting disc is provided, there is a tendency for the apparatus to "walk" sideways as the torque from the cutting process generates a sideways force of several tonnes. This may be resisted by tying the tractor (or other vehicle) by chains or like members. Therefore, one further alternative may include providing a pair of cutting wheels which may rotate in a contra rotating manner such that the sideways force of one is cancelled by the other.

Multiple cutting discs may be arranged in a single line perpendicular to the motion of the machine. Thus, a first cutting disc may cut an initial trench and a second one may deepen it.

The cutting wheel can be trust into the rock with a force of about 8,000 lb or 4 tonnes. This implies a cutting force of about 2.5 tonnes which in turn requires a torque of about 5,000 Nm if the cutting disc is about 400 mm in diameter. Larger cutting discs will require larger forces and larger torques. By making the cutting disc free of picks in the vicinity of the wedge, all the thrust and torque is available to push the wedge into the groove to break the under-cut material away.

It should be appreciated that various other changes and modifications may be made to the embodiment described without departing from the spirit and scope of the invention.

I claim:

1. An apparatus for cutting and breaking a solid, the apparatus having a cutting disc with a peripheral edge, a top wall and a bottom wall, a first wedge extending from the top wall, and a second wedge extending from the bottom wall, said first and second wedges being spaced inwardly relative to the peripheral edge of the cutting disc, the peripheral edge being provided with a plurality of cutting picks.

2. The apparatus as claimed in claim 1, wherein the first and second wedges are connected together.

3. The apparatus as claimed in claim 2, wherein the first and second wedges are releasably mounted relative to each other, and to the cutting disc.

4. The apparatus of claim 3, wherein at least one of said first and second wedges has an inclined leading face.

5. The apparatus as claimed in claim 4, wherein the inclined angle is between 1 to 10 degrees.

6. The apparatus as claimed in claim 1, further comprising a rotatable shaft member connected to the cutting disc, the shaft member being rotatably driven by a drive.

7. The apparatus of claim 6, including means for biasing the rotatable shaft member and the cutting disc against the solid to be cut.

8. The apparatus as claimed in claim 7, wherein said means for biasing provides sufficient force to the cutting disc to allow it to cut into the solid, but allows the shaft member to kick back should the wedge become jammed or stuck within the solid.

9. The apparatus as claimed in claim 8, wherein said drive and biassing means is supported by frame assembly which is attachable to a vehicle.

10. The apparatus as claimed in claim 9, in combination with the vehicle, and including ground engageable stabilisers to restrict sideways movement of the vehicle upon use of the apparatus.

11. An apparatus for cutting and breaking a solid, the apparatus comprising a member having a centre of rotation and adapted to be mounted for rotation to a shaft, the member having a generally planar main body portion and a peripheral edge, the peripheral edge having a cutting edge adapted to accommodate a plurality of cutting picks, a top of the peripheral edge being raised above the main body portion extending immediately behind the peripheral edge, and at least one wedge located on the main body portion and spaced inwardly relative to the peripheral edge.

12. The apparatus of claim 11 wherein said at least one wedge is mounted for rotation relative to the main body portion.

13. The apparatus of claim 12, wherein said at least one wedge comprises a first wedge extending from a top wall of the main body portion and a second wedge extending from a bottom wall of the main body portion.

14. The apparatus of claim 12, wherein said at least one wedge is movable between an extended and retracted position relative to the main body member.

15. The apparatus of claim 11, wherein said at least one wedge is movable between an extended and a retracted position relative to the main body member.

16. An apparatus for cutting and breaking a solid, the apparatus comprising a member having a centre of rotation and adapted to be mounted for rotation to a shaft, the member having a generally planar main body portion and a peripheral edge, the peripheral edge having a cutting edge adapted to accommodate a plurality of cutting picks, the apparatus further having a first wedge extending from a top wall of the main body portion, and a second wedge extending from a bottom wall of the main body portion, the wedges being mounted for rotation relative to the main body portion.

17. The apparatus of claim 16, wherein said at least said first wedge is movable between an extended and retracted position relative to the main body member.

18. An apparatus for cutting and breaking a solid, the apparatus comprising a member having a centre of rotation and adapted to be mounted for rotation to a shaft, the member having a generally planar main body portion and a peripheral edge, the peripheral edge having a cutting edge adapted to accommodate a plurality of cutting picks, the apparatus further having a wedge located on the main body portion, the wedge being movable between an expanded and a retracted position relative to the main body portion.

* * * * *